United States Patent [19]

Brewer et al.

[11] 4,044,416

[45] Aug. 30, 1977

[54] SURFBOARD WITH ADJUSTABLE FIN

[76] Inventors: Charles A. Brewer, 72957 Joshua Tree St., Palm Desert, Calif. 92660; Richard A. Brewer, 61479 Kamehameha Highway, Honolulu, Hawaii 96712

[21] Appl. No.: 696,088

[22] Filed: June 14, 1976

[51] Int. Cl.[2] ..... A63C 15/00

[52] U.S. Cl. ..... 9/310 E

[58] Field of Search ..... 9/310 E, 310 R; 114/140

[56] References Cited

U.S. PATENT DOCUMENTS

| | | | |
|---|---|---|---|
| 3,579,681 | 5/1971 | Pope et al. | 9/310 E |
| 3,585,663 | 6/1971 | Johnson | 9/310 E |
| 3,965,514 | 6/1976 | Shafer et al. | 9/310 E |

*Primary Examiner*—Trygve M. Blix
*Assistant Examiner*—Stuart M. Goldstein
*Attorney, Agent, or Firm*—Benoit Law Corporation

[57] ABSTRACT

A fin for a surfboard has a longitudinal fin base. A fin holder in the underside of the surfboard defines an elongate channel extending lengthwise of the surfboard for receiving the fin base for lengthwise adjustment of the fin relative to the surfboard. A clamp is slidable lengthwise in that channel and is engageable with the fin holder and the fin base for releasably retaining the fin relative to the surfboard.

62 Claims, 7 Drawing Figures

SURFBOARD WITH ADJUSTABLE FIN

BACKGROUND OF THE INVENTION

1. Field of the Invention

The subject invention relates to surfboard structures and, more specifically, to surfboards with adjustable fins and to adjustable fin holders.

2. Description of the Prior Art

In order to provide for improved surfboard handling and surfer performance, it is important that the fin of a surfboard be longitudinally adjustable.

In this respect, one prior-art proposal provides a keel or fin holder attached to the surfboard with a plurality of apertures. The keel or fin, in turn, is longitudinally slidable in the keel or fin holder and has a number of corresponding openings. Retractable fastening devices extend through corresponding apertures and holes to hold the adjusted fin in position (see U.S. Pat. No. 3,308,493).

In practice, it has been found that fin adjustment as small as some 3 millimeters can have a discernible effect on the precision control of the board by a skilled surfer. Such a fine control, however, is not feasible with the construction according to the above mentioned prior-art proposal, since the requisite multitude of holes for apertures in the fin base or holder would seriously weaken the structure, promoting accidental separation of the fin from the board.

In an effort to solve this problem, another prior-art proposal U.S. Pat. No. 3,564,632) has provided a channel member in the underside of the surfboard for receiving the base member of a fin. Releasable fasteners interconnect the channel member and the base member for creating frictional engagement of the base member with the channel member in an endeavor to provide secured, longitudinal positioning with infinite adjustment of the fin along the length of the channel member.

In practice, orientation in terms of an infinite adjustment leads to undesirable limitations. In particular, such insistence limits suitable fastening techniques to those relying on frictional engagement of the fin base member with the channel member. This, in turn, has necessitated the use of fastening devices which have proved awkward to handle and exposed to deterioration in a marine environment. This problem has persisted even after a replacement of one of the formerly two fastening devices by a transverse pin which rides in lateral slots in the channel member.

SUMMARY OF THE INVENTION

It is a broad object of this invention to overcome the above mentioned disadvantages.

It is a related object of this invention to provide improved surfboard structures, surfboard fin holders and fin adjustment techniques and devices.

It is a more particular object of this invention to avoid the inherent drawbacks of surfboard fin fastener devices with infinite adjustment, while avoiding at the same time the limitations of prior-art finite-type fin adjusting constructions.

From a first aspect thereof, the subject invention resides in a surfboard structure comprising, in combination, a surfboard, a fin for the surfboard having a longitudinal fin base including a bifurcated end portion having a slot extending parallel to said fin, a fin holder in the underside of the surfboard defining an elongate channel extending lengthwise of the surfboard for receiving the fin base for lengthwise adjustment of the fin relative to the surfboard, means slidable lengthwise in the channel and engageable with a fin holder and fin base for releasably retaining the fin relative to the surfboard, said retaining means including a clamp having a mouth portion for receiving the bifurcated end portion and having a web at the mouth portion extending parallel to the fin and fitting within the slot in the bifurcated end, and means operatively associated with the fin holder and slidable means for incrementally varying the location of the slidable means. These means for incrementally varying the mentioned location include means for providing a plurality of finite steps along a portion of the fin holder, and for selectively arresting sliding movement of the slidable means in any of the finite steps.

In the further course of this disclosure, it will be appreciated that the imcremental variation of the location of the releasable retention of the fin, the disclosed provision of a plurality of finite steps and the selective arrestation of the slidable means provide improved surfboard structures in which the drawbacks of infinite-type adjustment devices, as well as the limitations of finite-type prior-art adjustment proposals are avoided.

From another aspect thereof, the invention resides in a surfboard structure comprising, in combination, a surfboard, a fin for the surfboard having a longitudinal fin base with first and second end portions, a fin holder in the underside of the surfboard defining an elongate channel extending lengthwise of the surfboard for receiving the fin base for lengthwise adjustment of the fin relative to the surfboard, and means engageable with the fin holder and fin base for releasably retaining the fin relatively to the surfboard at variable locations. These retaining means include a clamp having a mouth portion for receiving one of the first and second end portions of the fin base and having a manually engageable top portion projecting out of the fin holder and reaching over the one end portion of the fin base into engagement with the one end portion, means for mounting the clamp for lengthwise sliding movement in the fin holder, and means for selectively arresting movement of the clamp in the fin holder.

Further aspects of this invention concern articles of manufacture comprising combinations of the defined fin holder, with the disclosed slidable means or clamp and incremental arrestation devices.

BRIEF DESCRIPTION OF THE DRAWINGS

The subject invention and its objects and aspects will become more readily apparent from the following detailed description of preferred embodiments thereof, illustrated by way of example in the accompanying drawings, in which like reference numerals designate like or functionally equivalent parts, and in which.

DESCRIPTION OF THE PREFERRED EMBODIMENTS

Figures 1, 2, 3, 4, 5, 6, 7:
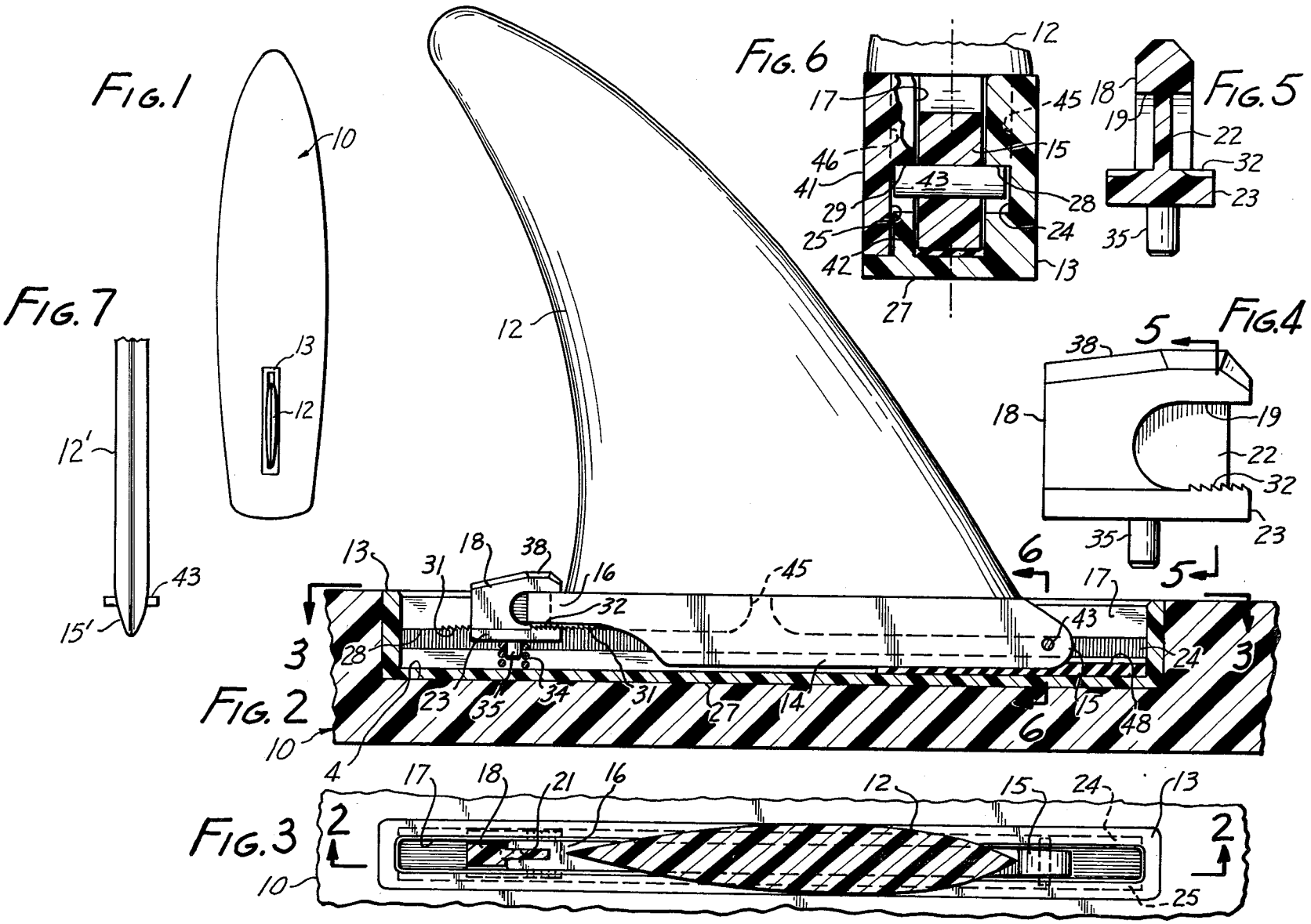
FIG. 1 is a bottom plan view of a surfboard equipped with adjustable fin and fin holder in accordance with a preferred embodiment of the subject invention.
FIG. 2 is a fractional view, on an enlarged scale, of a detail of the surfboard, taken along the line 2 — 2 in FIGS. 1 and 3, and including an adjustable fin and fin holder according to a preferred embodiment of the subject invention.
FIG. 3 is a view taken along the line 3 — 3 in FIG. 2.
FIG. 4 is a side view, on an enlarged scale, of a clamp used in the fin holders of FIGS. 1 to 3.
FIG. 5 is a section taken along the line 5 — 5 in FIG. 4.
FIG. 6 is a section, on an enlarged scale, taken along the line 6 — 6 in FIG. 2.
FIG. 7 is a fractional top view of a fin usable in the illustrated fin holder in accordance with a further preferred embodiment of the subject invention.

A surfboard 10 of any desired type, configuration, length, construction and composition, has a fin 12 adjustably mounted in a fin holder 13 fitted into and retained in a recess or slot 4 in the board. If desired, the holder 13 may be retained in the slot 4 by an adhesive. For instance, in the case of boards made or finished with fiberglas and a bonding resin, the fin holder 13 may be mounted in a recess on the underside of the board by the bonding resin.

In practice, the illustrated preferred embodiment of the invention is capable of handling various fin types, such as the fin brands available in the trade under the trademarks BREWER, HYNSON and DOWNING. However, it should be understood that the basic concept of the subject invention is also able to handle other kinds of fins or keels.

The illustrated fin 12 has a longitudinal or elongate fin base having first and second end portions 15 and 16. The fin holder 13 defines an elongate channel 17 extending fore-and-aft, lengthwise or longitudinally of the surfboard 10 for receiving the fin base 14 for lengthwise adjustment of the fin 12 relative to the surfboard.

A clamp 18 is slidable lengthwise in the channel and engageable with the fin holder 13 and fin base 14 for releasably retaining the fin relative to the surfboard 10.

The clamp 18 is capable of incrementally varying the location of the releasable retention of the fin 12.

In the illustrated preferred embodiment of the invention, the clamp 18 has a mouth portion 19 for receiving the second end portion 16 of the fin base 14. In accordance with a further preferred embodiment of the invention, the fin base end portion 16 is bifurcated as shown in FIG. 3, having a slot 21 extending parallel to the fin 12. The clamp 18, on the other hand, has a web 22 at the mouth 19, fitting within the slot 21 or bifurcation of the end portion 16 of the fin base, and extending also parallel to the relatively narrow fin 12. This interfitting relationship of the fin base 14 and clamp 18 imparts increased stability to the mounted fin 12 thereby augmenting the control exertable by a skilled surfer on the board 10.

The clamp 18 has lateral protrusions or shoulder members 23 at its base which ride in slots 24 and 25 provided in the fin holder 13 laterally of the longitudinal channel 17 and which reach under the second end portion 16 of the fin base 14 in the fin holder 13 at the lower end of the mouth portion 19. In the illustrated preferred embodiment, the slots are delimited in a direction away from the inserted fin 12 and toward the board 10 by a bottom 27 of the fin holder 13. The slots 24 and 25 are also delimited by ledge members 28 and 29 visible in FIGS. 2 and 6.

In accordance with a further preferred embodiment of the subject invention, the ledge members 28 and 29 are shaped to provide a plurality of finite steps or detents distributed along a portion of the fin holder 13. This may, for instance, be accomplished by providing the ledge members and/or clamp with serrated portions or saw tooth configurations.

By way of example, a series of unidirectionally oriented detent teeth 31 are formed in the ledge members 28 and 29 for a sufficient length to permit retention of the fin 12 in any desired adjusted position in the holder 13. Corresponding detent teeth 32 are in the illustrated preferred embodiment provided on the lateral protrusions or shoulder members 23 of the clamp 18 to be selectively meshable with the detent teeth 31. In this manner, sliding movement of the clamp 18 is arrested in any of the finite steps defined by the teeth 31.

Resilient means in the exemplary form of a helical spring 34 extend between the bottom 27 of the fin holder and the clamp 18, and are retained at the clamp by a pin 35 attached to or integral with the bottom of the clamp. The spring 34 biases the teeth 32 into engagement with the teeth 31 in any position of the clamp and thus releasably retains any adjusted arrestation of the clamp 18.

The pin 35 is short enough to permit the clamp 18 to be manually depressed into the fin holder 13 whereby the teeth 32 are disengaged from the teeth 31 and the clamp 18 may be slid to another position in the fin holder 13, where the clamp 18 may again be arrested by mutual engagement of the teeth 31 and 32 and the bias action of the spring 34. This spring 34 is preferably made of a non-corrosive stainless steel or another corrosion resistant spring material.

In principle, the teeth 31 may be dispensed with if the clamp 18 is made of metal or another hard material, the ledges 28 and 29 are made of a plastic or other yieldable material, and the teeth 32 are sufficiently sharp to bite into the ledge members 28 and 29 under the bias of a strong spring 34. While this and similar alternatives would be within the purview of the subject invention, it is preferable in practice to provide both the teeth 31 and the teeth 32 or at least similar mutually engageable detent means.

The clamp may be made of a molded plastic material and is preferably provided with a manually engageable top portion 38 projecting out of the fin holder 13 and reaching over the second end portion 16 of the fin base 14 into engagement with the second end portion. As seen in FIGS. 2, 4 and 5, the mouth portion 19 extends between the manually engageable top portion 38 and the clamp base at the protrusions or shoulder members 23.

In contrast to prior-art proposals and designs, which require special tools, such as screw drivers, wrenches and the like, which are easily lost during surfing or become corroded at the beach, no tools are required with the fin holding devices of the subject invention.

In principle, the fin holder 13 could be made of a corrosion resistant metal. However, it is more advantageous to mold the holder 13 of a plastic material, whereby the ledge members 28 and 29 and the teeth 31 may be provided in the molding process along with the elongate channel 17.

In this respect, FIG. 2 shows two alternatives of a monolithically formed holder (right-hand side of FIG. 6) and of a two-part holder (left-hand side of FIG. 6). In the latter alternative, the bottom 27 may be in the form of a piece separate from a main body 41 of the holder. In that case, the bottom piece is preferably provided with a rim 42 which fits into a channel in the body 41 and which helps delimiting the lateral grooves 24 and 25. The bottom portion may in this case be attached to the body of the holder by an adhesive or in any other suitable manner.

If desired, the first end portion 15 of the fin base 14 may be retained in the holder 13 in any known manner. For instance, the end portion 15 may be equipped with a pin 43 that provides lateral projections which ride in the grooves 24 and 25 or on the ledge members 28 and 29.

In practice, the fin 12 is mounted by inserting its pin 43 through lateral openings 45 and 46 communicating in the holder 13 with the grooves 24 and 25. The fin 12 is then swung about an axis through the inserted pin 43 until the fin base 14 has been inserted into the channel 17. The clamp 18, which until then has been positioned clear of the fin base 14 is then depressed at 38 and moved into engagement with the fin end portion 16 as shown in FIGS. 2 and 3, at which point further motion of the clamp 18 may be arrested by a release of pressure at 38, whereby the spring 34 will move the clamp teeth 32 into engagement with the holder teeth 31.

The fin base 14 may be sufficiently wide to wedge itself against the sides of the holder 13. This imparts increases stability to the fin mount. Alternatively or additionally, a resilient device, such as a rubber pad 48 may be provided in the bottom of the holder 13 as shown in FIG. 2 in order to bias the pin 43 into firm engagement with the ledge portion 28 and 29. The pad 48 may be bonded to the holder bottom 27.

To facilitate insertion of the fin into the holder 13, the fin may have a configuration as shown at 12' in FIG. 7. In particular, the fin 12' may have a tapered end portion 15' at its base, into which the pin 43 is set. In that case, entry of the leading fin portion 15' into the holder and movement of the fin to the desired position relative to the board 10 are facilitated.

The subject extensive disclosure will suggest or render apparent to those skilled in the art various modifications and variations within the spirit and scope of the subject invention.

We claim:

1. A surfboard structure comprising in combination:

a surfboard;

a fin for said surfboard having a longitudinal fin base including a bifurcated end portion having a slot extending parallel to said fin;

a fin holder in the underside of said surfboard defining an elongate channel extending lengthwise of said surfboard for receiving said fin base for lengthwise adjustment of said fin relative to said surfboard;

means slidable lengthwise in said channel and engageable with said fin holder and fin base for releasably retaining said fin relative to said surfboard, said retaining means including a clamp having a mouth portion for receiving said bifurcated end portion and having a web at said mouth portion extending parallel to said fin and fitting within said slot in the bifurcated end; and means operatively associated with said fin holder and slidable means for incrementally varying the location of said slidable means, said means for incrementally varying said location including means for providing a plurality of finite steps along a portion of said fin holder, and for selectively arresting sliding movement of said slidable means in any of said finite steps.

2. A surfboard structure as claimed in claim 1, wherein:

said means for providing a plurality of finite steps include a plurality of detent means distributed along said fin holder portion.

3. A surfboard structure as claimed in claim 1, wherein:

said means for providing a plurality of finite steps include a plurality of detent means distributed along said fin holder portion, and means on said slidable means for selectively engaging said detent means.

4. A surfboard structure as claimed in claim 3, including:

resilient means connected to said slidable means for biasing said detent engaging means against said detent means.

5. A surfboard structure as claimed in claim 1, wherein:

said means for providing a plurality of finite steps include a plurality of detent teeth distributed along said fin holder and extending at an angle to the direction of said lengthwise adjustment of said fin, and means on said slidable means for selectively engaging said detent teeth.

6. A surfboard structure as claimed in claim 5, including:

resilient means connected to said slidable means for biasing said detent teeth engaging means against said detent teeth.

7. A surfboard structure as claimed in claim 1, wherein:

said means for providing a plurality of finite steps include a plurality of meshing first and second teeth on said fin holder and on said slidable means, respectively.

8. A surfboard structure as claim in claim 7, including:

resilient means for biasing said first and second teeth into releasable mutual engagement.

9. A surfboard structure as claimed in claim 1, wherein:

said fin holder has ledge means laterally of said channel; and said fin base has a lateral projection riding on said ledge means.

10. A surfboard structure comprising in combination:

a surfboard;

a fin for said surfboard having a longitudinal fin base having first and second end portions;

a fin holder in the underside of said surfboard defining an elongate channel extending lengthwise of said surfboard for receiving said fin base for lengthwise adjustment of said fin relative to said surfboard; and means engageable with said fin holder and fin base for releasably retaining said fin relatively to said surfboard at variable locations, said retaining means including a clamp having a mouth portion for receiving one of said first and second end portions of said fin base and having a manually engageable top portion projecting out of said fin holder and reaching over said one end portion of said fin base into engagement with said one end portion, means for mounting said clamp for lengthwise sliding movement in said fin holder, and means for selectively arresting movement of said clamp in said fin holder.

11. A surfboard structure as claimed in claim 10, wherein:

said movement arresting means include means operatively associated with said fin holder and said clamp for providing a plurality of finite steps along a portion of said fin holder and for selectively arresting movement of said clamp in any of said finite steps.

12. A surfboard structure as claimed in claim 11, wherein:

said means for providing a plurality of finite steps include a plurality of detent means distributed along said fin holder portion.

13. A surfboard structure as claimed in claim 11, wherein:

said means for providing a plurality of finite steps include a plurality of detent means distributed along said fin holder portion, and means on said clamp for selectively engaging said detent means.

14. A surfboard structure as claimed in claim 13, including:

resilient means connected to said clamp for biasing said detent engaging means against said detent means.

15. A surboard structure as claimed in claim 11, wherein:

said means for providing a plurality of finite steps include a plurality of detent teeth distributed along said fin holder and extending at an angle to the direction of said lengthwise adjustment of said fin, and means on said clamp for selectively engaging said detent teeth.

16. A surfboard structure as claimed in claim 15, including:

resilient means connected to said clamp for biasing said detent teeth engaging means against said detent teeth.

17. A surfboard structure as claimed in claim 11, wherein:

said means for providing a plurality of finite steps include a plurality of meshing first and second teeth on said fin holder and on said clamp, respectively.

18. A surfboard structure as claimed in claim 17, including:

resilient means for biasing said first and second teeth into releasable mutual engagement.

19. A surfboard structure as claimed in claim 10, wherein:

said fin holder has ledge means laterally of said channel; and the other of said first and second end portions has a lateral projection riding on said ledge means.

20. A surfboard structure as claimed in claim 10, wherein:

said fin holder has ledge means laterally of said channel; and said clamp mounting means include a lateral projection riding on said ledge means.

21. A surfboard structure as claimed in claim 10, wherein:

said fin holder has ledge means laterally of said channel; and said clamp mounting means and the other of said first and second portions have lateral projections riding on said ledge means.

22. A surfboard structure as claimed in claim 10, wherein:

said fin holder has ledge means laterally of said channel;

said clamp mounting means include a lateral projection riding on said ledge means; and said movement arresting means include a plurality of detent means on said ledge means, means on said lateral projection of said clamp for selectively engaging said detent means and means connected to said clamp for biasing said engaging means against said detent means.

23. A surfboard structure as claimed in claim 10, wherein:

said fin holder has ledge means laterally of said channel;

said clamp mounting means include a lateral projection riding on said ledge means; and said movement arresting means include detent means on said lateral projection of said clamp, and means connected to said clamp for biasing said detent means into engagement with said ledge means.

24. An article of manufacture for adjustably mounting a fin having a longitudinal fin base including a bifurcated end portion having a slot extending parallel to said fin at the underside of a surfboard, comprising in combination:

a fin holder adapted to be mounted in the underside of said surfboard and defining an elongate channel extending lengthwise of said surfboard for receiving said fin base for lengthwise adjustment of said fin relative to said surfboard;

means slidable lengthwise in said channel and engageable with said fin holder and fin base for releasably retaining said fin relative to said surfboard, said retaining means including a clamp having a mouth portion for receiving said bifurcated end portion and having a web at said mouth portion extending parallel to said fin and fitting within said slot in the bifurcated end portion when said fin base is in said fin holder; and means operatively associated with said fin holder and slidable means for incrementally varying the location of said slidable means, said means for incrementally varying said location including means for providing a plurality of finite steps along a portion of said fin holder, and for selectively arresting sliding movement of said slidable means in any of said finite steps.

25. An article of manufacture as claimed in claim 24, wherein:

said means for providing a plurality of finite steps include a plurality of detent means distributed along said fin holder portion.

26. An article of manufacture as claimed in claim 24, wherein:

said means for providing a plurality of finite steps include a plurality of detent means distributed along said fin holder portion, and means on said slidable means for selectively engaging said detent means.

27. An article of manufacture as claimed in claim 26, including:

resilient means connected to said slidable means for biasing said detent engaging means against said detent means.

28. An article of manufacture as claimed in claim 24, wherein:

said means for providing a plurality of finite steps include a plurality of detent teeth distributed along said fin holder and extending at an angle to the direction of said lengthwise adjustment of said fin, and means on said slidable means for selectively engaging said detent teeth.

29. An article of manufacture as claimed in claim 28, including:

resilient means connected to said slidable means for biasing said detent teeth engaging means against said detent teeth.

30. An article of manufacture as claimed in claimed in claim 24, wherein:

said means for providing a plurality of finite steps include a plurality of meshing first and second teeth on said fin holder and on said slidable means, respectively.

31. An article of manufacture as claimed in claim 30, including:

resilient means for biasing said first and second teeth into releasable mutual engagement.

32. An article of manufacture as claimed in claim 24, wherein:

said fin holder has ledge means laterally of said channel; and said fin base has a lateral projection riding on said ledge means.

33. An article of manufacture for adjustably mounting a fin including a longitudinal fin base having first and second end portions at the underside of a surfboard comprising in combination:

a fin holder adapted to be mounted in the underside of said surfboard and defining an elongate channel extending lengthwise of said surfboard for receiving said fin base for lengthwise adjustment of said fin relative to said surfboard; and means engageable with said fin holder and fin base for releasably retaining said fin relatively to said surfboard at variable locations, said retaining means including a clamp having a mouth portion for receiving one of said first and second end portions of said fin base and having a manually engageable top portion projecting out of said fin holder and reaching over said one end portion for engagement with said one end portion when said fin base is in said fin holder, means for mounting said clamp for lengthwise sliding movement in said fin holder, and means for selectively arresting movement of said clamp in said fin holder.

34. An article of manufacture as claimed in claim 33, wherein:

said movement arresting means include means operatively associated with said fin holder and said clamp for providing a plurality of finite steps along a portion of said fin holder and for selectively arresting movement of said clamp in any of said finite steps.

35. An article of manufacture as claimed in claim 34, wherein:

said means for providing a plurality of finite steps include a plurality of detent means distributed along said fin holder portion.

36. An article of manufacture as claimed in claim 34, wherein:

said means for providing a plurality of finite steps include a plurality of detent means distributed along said fin holder portion, and means on said clamp for selectively engaging said detent means.

37. An article of manufacture as claimed in claim 36, including:

resilient means connected to said clamp for biasing said detent engaging means against said detent means.

38. An article of manufacture as claimed in claim 34, wherein:

said means for providing a plurality of finite steps include a plurality of detent teeth distributed along said fin holder and extending at an angle to the direction of said lengthwise adjustment of said fin, and means on said clamp for selectively engaging said detent teeth.

39. An article of manufacture as claimed in claim 38, including:

resilient means connected to said clamp for biasing said detent teeth engaging means against said detent teeth.

40. An article of manufacture as claimed in claim 34, wherein:

said means for providing a plurality of finite steps include a plurality of meshing first and second teeth on said fin holder and on said clamp, respectively.

41. An article of manufacture as claimed in claim 40, including:

resilient means for biasing said first and second teeth into releasable mutual engagement.

42. An article of manufacture as claimed in claim 33, wherein:

said fin holder has ledge means laterally of said channel; and the other of said first and second end portions has a lateral projection riding on said ledge means.

43. An article of manufacture as claimed in claim 33, wherein:

said fin holder has ledge means laterally of said channel; and said clamp mounting means include a lateral projection riding on said ledge means.

44. An article of manufacture as claimed in claim 33, wherein:

said fin holder has ledge means laterally of said channel; and said clamp mounting means and the other of said first and second portions have lateral projections riding on said ledge means.

45. An article of manufacture as claimed in claim 33, wherein:

said fin holder has ledge means laterally of said channel;

said clamp mounting means include a lateral projection riding on said ledge means; and said movement arresting means include a plurality of detent means on said ledge means, means on said lateral projection of said clamp for selectively engaging said detent means and means connected to said clamp for biasing said engaging means against said detent means.

46. An article of manufacture as claimed in claim 33, wherein:

said fin holder has ledge means laterally of said channel;

said clamp mounting means include a lateral projection riding on said ledge means; and said movement arresting means include detent means on said lateral projection of said clamp, and means connected to said clamp for biasing said detent means for engagement with said ledge means.

47. An article of manufacture as claimed in claim 33, wherein:

said one end portion of said fin base is bifurcated; and said clamp has a web at said mouth portion fitting within the bifurcation of said one end portion.

48. An article of manufacture as claimed in claim 33, wherein:

said one end portion of said fin base has a slot extending parallel to said fin; and said clamp has a web at said mouth portion extending parallel to said fin and fitting within said slot.

49. A surfboard structure as claimed in claim 10, wherein:

said one end portion is bifurcated having a slot extending parallel to said fin; and said clamp has a web at said mouth portion extending parallel to said fin and fitting within said slot in the bifurcated end.

50. A surfboard structure as claimed in claim 33, wherein:

said one end portion is bifurcated, having a slot extending parallel to said fin; and said clamp has a web at said mouth portion extending parallel to said fin and fitting within said slot when said fin base is in said fin holder.

51. A surfboard structure comprising in combination:

a surfboard;

a fin for said surfboard having a longitudinal fin base;

a fin holder in the underside of said surfboard defining an elongate channel extending lengthwise of said surfboard for receiving said fin base for lengthwise adjustment of said fin relative to said surfboard;

means slidable lengthwise in said channel and engageable with said fin holder and fin base for releasably retaining said fin relative to said surfboard; and means operatively associated with said fin holder and slidable means for incrementally varying the location of said slidable means including a plurality of detent means distributed along a portion of said fin holder for providing a plurality of finite steps along said fin holder portion, means on said slidable means for selectively engaging said detent means and arresting sliding movement of said slidable means in any of said finite steps and resilient means connected to said slidable means for biasing said detent engaging means against said detent means.

52. A surfboard structure comprising in combination:

a surfboard;

a fin for said surfboard having a longitudinal fin base;

a fin holder in the underside of said surfboard defining an elongate channel extending lengthwise of said surfboard for receiving said fin base for lengthwise adjustment of said fin relative to said surfboard;

means slidable lengthwise in said channel and engageable with said fin holder and fin base for releasably retaining said fin relative to said surfboard; and means operatively associated with said fin holder and slidable means for incrementally varying the location of said slidable means including a plurality of detent teeth distributed along a portion of said fin holder and extending at an angle to the direction of said lengthwise adjustment of said fin for providing a plurality of finite steps along said fin holder portion, means on said slidable means for selectively engaging said detent teeth and arresting sliding movement of said slidable means in any of said finite steps, and resilient means connected to said slidable means for biasing said detent teeth engaging means against said detent teeth.

53. A surfboard structure comprising in combination:

a surfboard;

a fin for said surfboard having a longitudinal fin base;

a fin holder in the underside of said surfboard defining an elongate channel extending lengthwise of said surfboard for receiving said fin base for lengthwise adjustment of said fin relative to said surfboard;

means slidable lengthwise in said channel and engageable with said fin holder and fin base for releasably retaining said fin relative to said surfboard; and means operatively associated with said fin holder and slidable means for incrementally varying the location of said slidable means including a plurality of meshing first and second teeth on a portion of said fin holder and on said slidable means, respectively, for providing a plurality of finite steps along said fin holder portion, and for selectively arresting sliding movement of said slidable means in any of said finite steps, and resilient means for biasing said first and second teeth into releasable mutual engagement.

54. A surfboard structure comprising in combination:

a surfboard;

a fin for said surfboard having a longitudinal fin base having first and second end portions;

a fin holder in the underside of said surfboard defining an elongate channel extending lengthwise of said surfboard for receiving said fin base for lengthwise adjustment of said fin relative to said surfboard; and means engageable with said fin holder and fin base for releasably retaining said fin relatively to said surfboard at variable locations, said retaining means including a clamp having a mouth portion for receiving one of said first and second end portions of said fin base, means for mounting said clamp for lengthwise sliding movement in said fin holder, means for selectively arresting movement of said clamp in said fin holder including detent means distributed along a portion of said fin holder, means on said clamp for selectively engaging said detent means and for selectively arresting movement of said clamp, and resilient means connected to said clamp for biasing said detent engaging means against said detent means.

55. A surfboard structure comprising in combination:

a surfboard;

a fin for said surfboard having a longitudinal fin base having first and second end portions;

a fin holder in the underside of said surfboard defining an elongate channel extending lengthwise of said surfboard for receiving said fin base for lengthwise adjustment of said fin relative to said surfboard; and means engageable with said fin holder and fin base for releasably retaining said fin relatively to said surfboard at variable locations, said retaining means including a clamp having a mouth portion for receiving one of said first and second end portions of said fin base, means for mounting said clamp for lengthwise sliding movement in said fin holder, means for selectively arresting movement of said clamp in said fin holder including detent teeth distributed along a portion of said fin holder and extending at an angle to the direction of said lengthwise adjustment, means on said clamp for selectively engaging said detent teeth and for selectively arresting movement of said clamp, and resilient means connected to said clamp for biasing said detent teeth engaging means against said detent teeth.

56. A surfboard structure comprising in combination:

a surfboard;

a fin for said surfboard having a longitudinal fin base having first and second end portions;

a fin holder in the underside of said surfboard defining an elongate channel extending lengthwise of said surfboard for receiving said fin base for lengthwise adjustment of said fin relative to said surfboard; and means engageable with said fin holder and fin base for releasably retaining said fin relatively to said surfboard at variable locations, said retaining means including a clamp having a mouth portion for receiving one of said first and second end portions of said fin base, means for mounting said clamp for lengthwise sliding movement in said fin holder, means for selectively arresting movement of said clamp in said fin holder including a plurality of meshing first and second teeth on said fin holder and said clamp, respectively, for providing a plurality of finite steps along a portion of said fin holder and for selectively arresting movement of said clamp in any of said finite steps, and resilient means for biasing said first and second teeth into releasable mutual engagement.

57. An article of manufacture for adjustably mounting a fin having a longitudinal fin base at the underside of a surfboard, comprising in combination:

a fin holder adapted to be mounted in the underside of said surfboard and defining an elongate channel extending lengthwise of said surfboard for receiving said fin base for lengthwise adjustment of said fin relative to said surfboard;

means slidable lengthwise in said channel and engageable with said fin holder and fin base for releasably retaining said fin relative to said surfboard; and means operatively associated with said fin holder and slidable means for incrementally varying the location of said slidable means, said means for incrementally varying said location including a plurality of detent means for providing a plurality of finite steps along a portion of said fin holder, means on said slidable means for selectively engaging said detent means and arresting sliding movement of said slidable means in any of said finite steps, and resilient means connected to said slidable means for biasing said detent engaging means against said detent means.

58. An article of manufacture for adjustably mounting a fin having a longitudinal fin base at the underside of a surfboard, comprising in combination:

a fin holder adapted to be mounted in the underside of said surfboard and defining an elongate channel extending lengthwise of said surfboard for receiving said fin base for lengthwise adjustment of said fin relative to said surfboard;

means slidable lengthwise in said channel and engageable with said fin holder and fin base for releasably retaining said fin relative to said surfboard; and means operatively associated with said fin holder and slidable means for incrementally varying the location of said slidable means, said means for incrementally varying said location including a plurality of detent teeth distributed along said fin holder and extending at an angle to the direction of said lengthwise adjustment of said fin for providing a plurality of finite steps along a portion of said fin holder, means on said slidable means for selectively engaging said detent teeth to arrest sliding movement of said slidable means in any of said finite steps, and resilient means connected to said slidable means for biasing said detent teeth engaging means against said detent teeth.

59. An article of manufacture for adjustably mounting a fin having a longitudinal fin base at the underside of a surfboard, comprising in combination:

a fin holder adapted to be mounted in the underside of said surfboard and defining an elongate channel extending lengthwise of said surfboard for receiving said fin base for lengthwise adjustment of said fin relative to said surfboard;

means slidable lengthwise in said channel and engageable with said fin holder and fin base for releasably retaining said fin relative to said surfboard; and means operatively associated with said fin holder and slidable means for incrementally varying the location of said slidable means, said means for incrementally varying said location including a plurality of meshing first and second teeth on said fin holder and on said slidable means, respectively, and resilient means for biasing said first and second teeth into releasable mutual engagement.

60. An article of manufacture for adjustably mounting a fin including a longitudinal fin base having first and second end portions at the underside of a surfboard comprising in combination:

a fin holder adapted to be mounted in the underside of said surfboard and defining an elongate channel extending lengthwise of said surfboard for receiving said fin base for lengthwise adjustment of said fin relative to said surfboard; and means engageable with said fin holder and fin base for releasably retaining said fin relatively to said surfboard at variable locations, said retaining means including a clamp having a mouth portion for receiving one of said first and second end portions of said fin base, means for mounting said clamp for lengthwise sliding movement in said fin holder, and means for selectively arresting movement of said clamp in said fin holder including detent means distributed along a portion of said fin holder, means on said clamp for selectively engaging said means and for selectively arresting movement of said clamp, and resilient means connected to said clamp for biasing said detent engaging means against said detent means.

61. An article of manufacture for adjustably mounting a fin including a lontitudinal fin base having first and second end portions at the underside of a surfboard comprising in combination:

a fin holder adapted to be mounted in the underside of said surfboard and defining an elongate channel extending lengthwise of said surfboard for receiving said fin base for lengthwise adjustment of said fin relative to said surfboard; and means engageable with said fin holder and fin base for releasably retaining said fin relatively to said surfboard at variable locations, said retaining means including a clamp having a mouth portion for receiving one of said first and second end portions of said fin base, means for mounting said clamp for lengthwise sliding movement in said fin holder, and means for selectively arresting movement of said clamp in said fin holder including detent teeth distributed along a portion of said fin holder and extending at an angle to the direction of said lengthwise adjustment, means on said clamp for selectively engaging said detent teeth and for selectively arresting movement of said clamp, and resilient means connected to said clamp for biasing said detent teeth engaging means against said detent teeth.

62. An article of manufacture for adjustably mounting a fin including a longitudinal fin base having first and second end portions at the underside of a surfboard comprising in combination:

a fin holder adapted to be mounted in the underside of said surfboard and defining an elongate channel extending lengthwise of said surfboard for receiving said fin base for lengthwise adjustment of said fin relative to said surfboard; and means engageable with said fin holder and fin base for releasably retaining said fin relatively to said surfboard at variable locations, said retaining means including a clamp having a mouth portion for receiving one of said first and second end portions of said fin base, means for mounting said clamp for lengthwise sliding movement in said fin holder, means for selectively arresting movement of said clamp in said fin holder including a plurality of meshing first and second teeth on said fin holder and said clamp, respectively, for providing a plurality of finite steps along a portion of said fin holder and for selectively arresting movement of said clamp in any of said finite steps, and resilient means for biasing said first and second teeth into releasable mutual engagement.

* * * * *